United States Patent [19]

Bischof et al.

[11] 4,074,091

[45] Feb. 14, 1978

[54] INTERLOCKING OPERATING MECHANISM FOR ENCLOSED SWITCHGEAR HAVING DEFEATER INTERLOCK

[75] Inventors: John F. Bischof, Richfield; Ronald J. Fritsch, Sussex, both of Wis.

[73] Assignee: Cutler-Hammer, Inc., Milwaukee, Wis.

[21] Appl. No.: 676,332

[22] Filed: Apr. 12, 1976

[51] Int. Cl.[2] ..... H01H 9/20

[52] U.S. Cl. ..... 200/50 A

[58] Field of Search ..... 200/50 A, 42 R, 42 A, 200/44, 318, 321-327, 329, 330, 334, 335, 337, 338

[56] References Cited

U.S. PATENT DOCUMENTS

| | | | |
|---|---|---|---|
| 3,055,995 | 9/1962 | Show | 200/44 |
| 3,192,334 | 6/1965 | Dimond et al. | 200/50 A |
| 3,274,353 | 9/1966 | Daly et al. | 200/50 A |
| 3,311,720 | 3/1967 | Johnson | 200/50 A |
| 3,324,259 | 6/1967 | Chamberlin, Jr. et al. | 200/50 A |
| 3,358,094 | 12/1967 | Metz | 200/50 A |

*Primary Examiner*—James R. Scott

*Attorney, Agent, or Firm*—Hugh R. Rather; William A. Autio; Michael E. Taken

[57] ABSTRACT

An operating mechanism for an enclosed circuit breaker is disclosed and comprises: a frame mounted within an enclosure; a linearly reciprocal handle slidably mounted to the frame for operating a circuit breaker within the enclosure and extending through an aperture in a door of the enclosure; and a latch pivotally mounted to the frame and cooperating with the handle and a catch on the door to perform interlocking functions whereby the door cannot be opened unless the handle is in an "off" position and whereby the handle cannot be moved to an "on" position unless the door is closed. A defeater is provided for manually pivoting the latch to defeat its interlocking functions.

24 Claims, 6 Drawing Figures

INTERLOCKING OPERATING MECHANISM FOR ENCLOSED SWITCHGEAR HAVING DEFEATER INTERLOCK

BACKGROUND OF THE INVENTION

Safety standards may require the provision of interlocking mechanisms for enclosed electrical switchgear and control devices. Such interlocks are desirable, for example, to permit access to the interior of an enclosure only when the control devices therein are in an "off" state or to permit operation of the control devices to an "on" state only when a door of the enclosure is closed. While such interlocks have been useful for their intended purposes this invention relates to improvements thereover.

SUMMARY OF THE INVENTION

This invention relates to an improved operating mechanism affording an automatic safety interlock.

An object of the invention is to provide an operating mechanism which permits access to and/or operation of enclosed electrical switchgear only under designated conditions.

Another object of the invention is to provide an operating mechanism of the aforementioned character which permits opening of an enclosure door only when switchgear within the enclosure is in an "off" or otherwise safe state, and which permits actuation of the switchgear to an "on" state only when the door is closed.

Another object of the invention is to provide an operating mechanism of the aforementioned character having a minimum number of parts and which is inexpensive to manufacture whereby to afford low cost interlock protection.

Another object of the invention is to provide an operating mechanism of the aforementioned character which can readily be used with conventional switchgear.

Another object of the invention is to provide an operating mechanism of the aforementioned character having means for defeating the interlocking functions thereof.

Another object of the invention is to provide an operating mechanism of the aforementioned character having a stationary frame mounted within an enclosure, a linearly reciprocal handle slidably mounted to the frame and extending through an aperture in the enclosure door, and a latch pivotally mounted to the frame and cooperating with the handle and a catch on the door to provide the aforesaid interlocking functions.

Another object of the invention is to provide an operating mechanism of the aforementioned character having a hasp for locking the handle in a desired position.

Other objects and advantages of the invention will hereinafter appear.

DESCRIPTION OF THE PREFERRED EMBODIMENT

Figure 1:
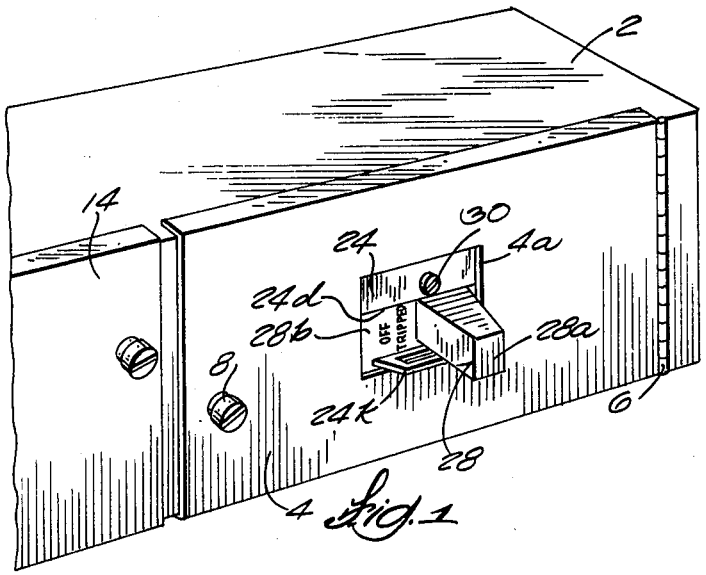
FIG. 1 is an isometric view of a portion of an enclosure with the door closed and the operating handle extending through an aperture therein.
Figure 2:
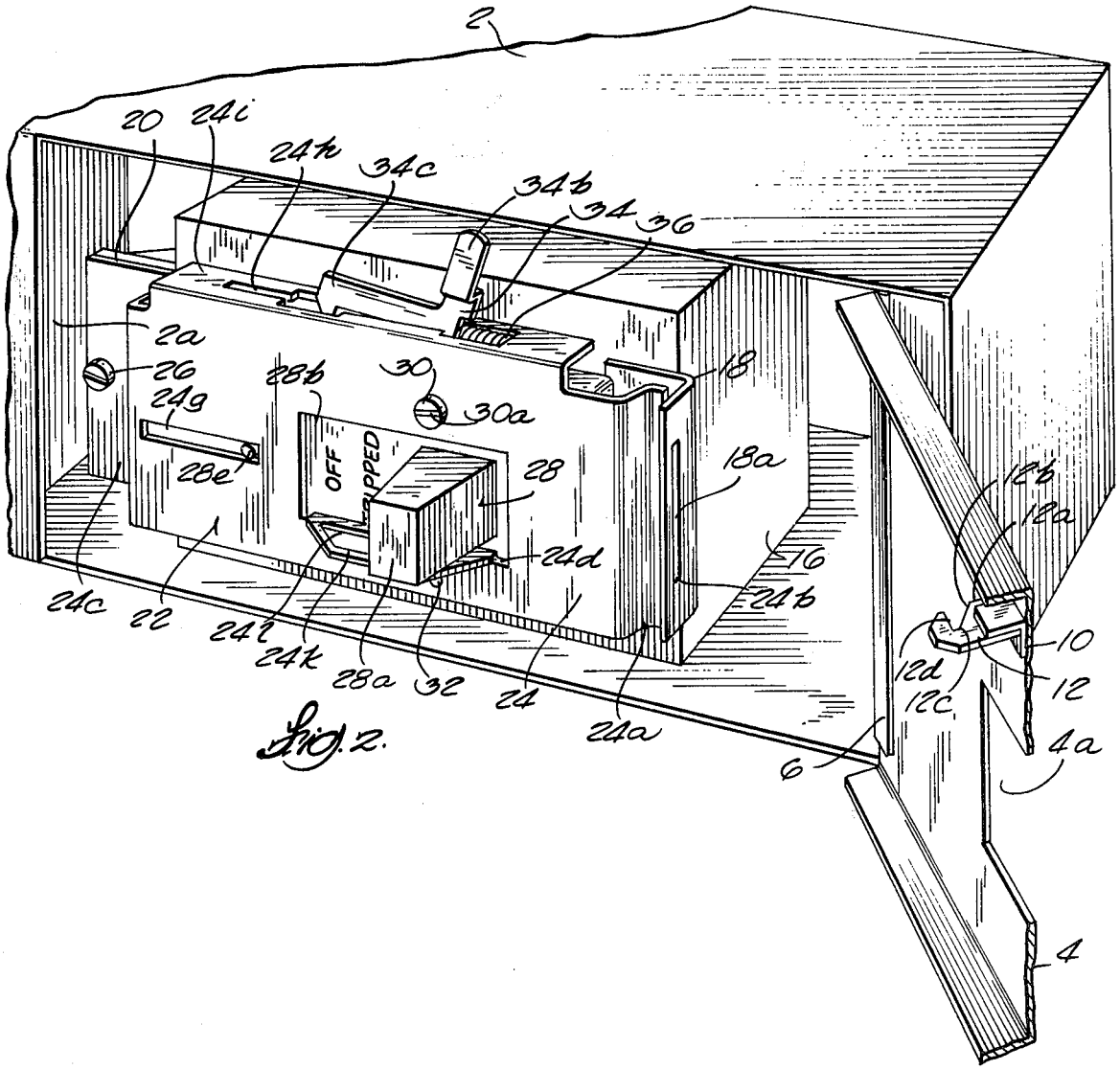
FIG. 2 is an isometric view of an enclosure with the door open to show the operating mechanism and a portion of the open door.

There is shown in FIGS. 1 and 2, a steel enclosure 2 commonly used for housing electrical switchgear and control apparatus. Such enclosures are commonly stacked or grouped to form a panelboard structure for centralized control of switching installations such as motor control centers or any other type of electrical control apparatus.

The enclosure has a door 4 mounted to the enclosure by a hinge 6. The door is held closed by a pin 8 extending through the door and having an L-shaped inner portion for engaging a slot (not shown) in a wall 2*a* of the enclosure upon turning of the pin when the door is closed. The door has an aperture 4*a* through which the handle of the operating mechanism extends when the door is closed. An L-shaped tab 10 is mounted to the inside of the door such that one of the legs of the tab extends perpendicularly to the plane of the door. A catch 12 is mounted to the latter mentioned leg of the tab and cooperates with the latch of the operating mechanism when the door is closed, as will be more fully described hereinafter. The enclosure may have other doors, such as 14, similarly constructed.

Mounted within the enclosure in a known manner is electrical control apparatus, such as a circuit breaker generally designated as 16. Such a circuit breaker is well-known in the art and forms no part of the present invention, but is shown to to illustrate a structural setting for the preferred form of the present invention. A pair of mounting brackets 18 and 20 are secured to the circuit breaker housing for mounting the operating mechanism, generally designated as 22.

The operating mechanism comprises a steel frame 24 having an end portion 24*a* bent inwardly and rightwardly, FIG. 2, with a tongue portion 24*b* at the end thereof received in a slot 18*a* in mounting bracket 18, and having another end portion 24*c* bent inwardly and leftwardly with an aperture therein for receiving a screw 26 therethrough, threaded into mounting bracket 20. Frame 24 is thus mounted by first inserting tongue 24*b* in slot 18*a* and then tightening screw 26.

Figure 3:
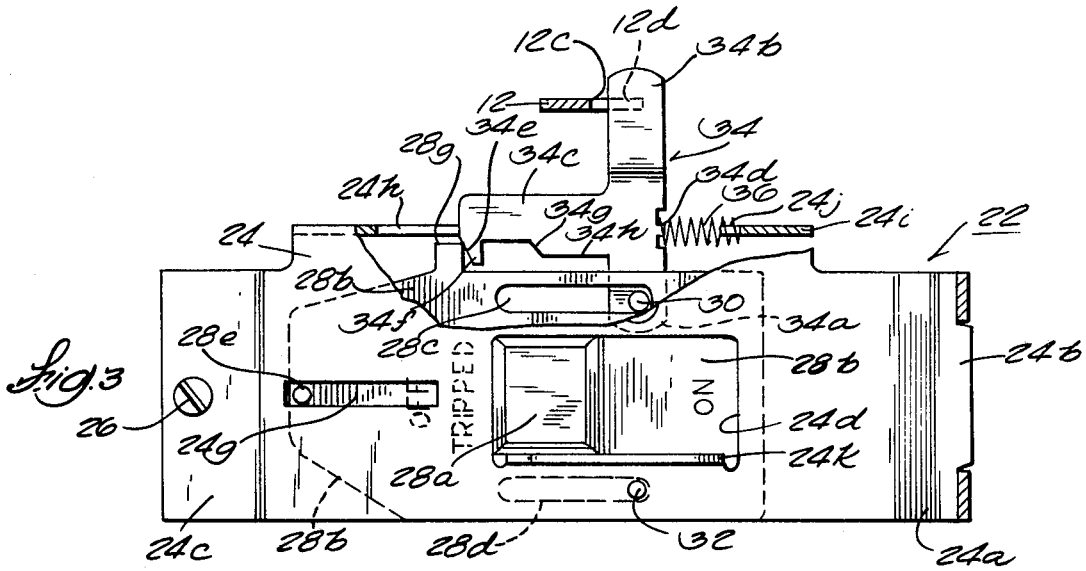
FIG. 3 is a front elevation view, partially broken away, showing the operating mechanism in its "on" position.
Figure 4:
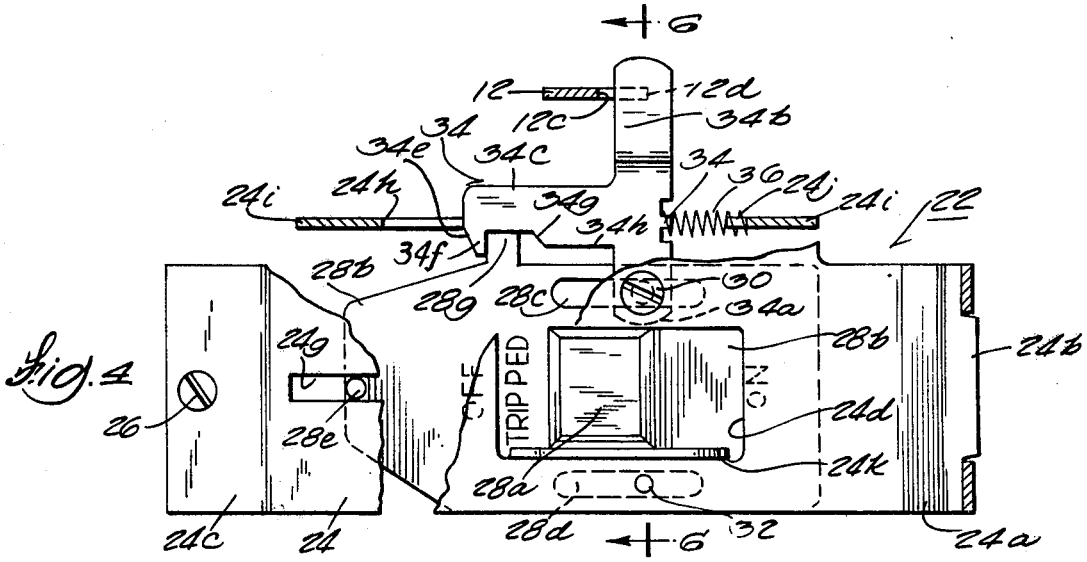
FIG. 4 is a front elevation view, partially broken away, showing the operating mechanism in its "tripped" position.
Figure 5:
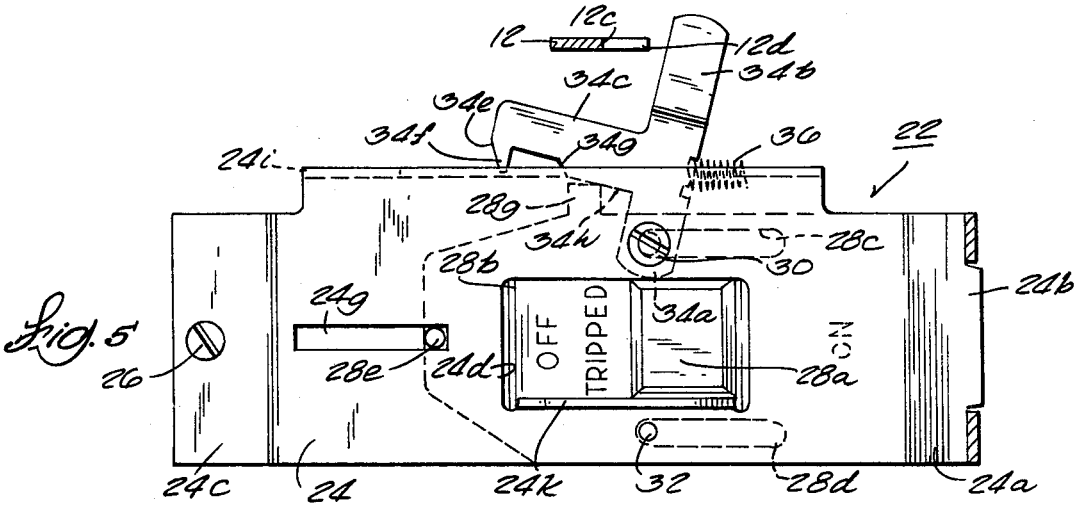
FIG. 5 is a front elevation view showing the operating mechanism in its "off" position.

The operating mechanism further comprises an operating handle 28 slidably mounted to the frame. This handle has an outer portion 28*a* which extends through an aperture 24*d* in the frame and through aperture 4*a* in the door when the door is closed. The handle has an inner generally planar portion 28*b* underlying the frame. As seen in FIGS. 3–5, portion 28*b* has a pair of elongated apertures 28*c* and 28*d* through which a pair of pins 30 and 32 extend, FIG. 6. These pins are mounted through circular apertures 24*e* and 24*f* in the frame and have enlarged flattened ends whereby to hold inner portion 28*b* of the handle against the underside of the frame. The reduced diameter middle portions of the pins are slightly longer than the width of inner portion 28*b* to permit sliding movement of the handle. Portion 28also has a cylindrical nib 28*e* extending outwardly through an elongated aperture 24*g* in the frame to provide additional guidance for the rectilinear left-right sliding movement of handle 28 with respect to stationary frame 24.

Figure 6:
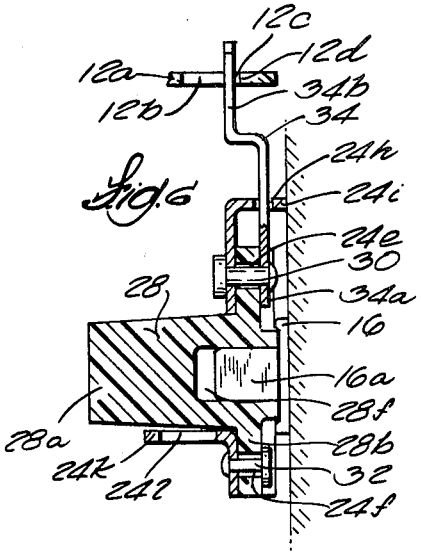
FIG. 6 is a cross-sectional view takan along line 6–6 of FIG. 4.

Portion 28*a* of the handle has a cavity 28*f*, FIG. 6, formed in the underside thereof for receiving an actuating handle 16*a* of circuit breaker 16. If the actuating handle is of the pivotally mounted rocker type, rocking into and out of the page as seen in FIG. 6, cavity 28*f* should be long enough to allow a sufficient arc path therein as the handle is rectilinearly moved into and out of the page as seen in FIG. 6, or right and left as seen in FIG. 2. As will be appreciated by those skilled in the art, other engagement means between the operating handle 28 and the circuit breaker are possible, though the embodiment shown is preferred because the operating mechanism may be directly mounted over a circuit breaker without modification of the latter.

Rigidly mounted to pin 30 and rotatable therewith is a latch 34, FIG. 6. As shown in FIG. 3, this latch is of generally T-shaped configuration and is pivoted about one of the arms 34*a* of the T. This arm extends through an elongated aperture 24*h*, FIGS. 2 and 6, in an inwardly bent side wall 24*i* of the frame. The other arm 34*b* of the T, FIG. 2, is bent outwardly and upwardly to cooperate with catch 12 as will be more fully described hereinafter. The trunk 34*c* of the T moves through aperture 24*h* upon pivoting of the latch.

Means are provided to bias the latch in a counterclockwise direction such as a helical compression spring 36 mounted between the right end of aperture 24*h* and the latch between the arms thereof. Nibs 34*d* and 24*j* are provided in the latch and side wall of the frame, respectively, for mounting the spring, FIG. 3.

FIG. 3 shows the operating mechanism in the "on" condition with handle 28 in its leftmost position, corresponding to a circuit completing condition of the circuit breaker. Only the "ON" indicia formed on inner portion 28*b* is exposed by aperture 24*d* of the frame. The "OFF" and "TRIPPED" indicia are covered by frame 24 and thus not visible. FIG. 4 shows the handle in an intermediate position wherein only "TRIPPED" is visible, indicating the circuit breaker has reacted to a predetermined condition, such as overload current, to disrupt the circuit. FIG. 5 shows the handle in its rightmost position indicating "OFF" and "TRIPPED".

Operation of the operating mechanism will be described first without the interaction of catch 12, i.e. with the door open. As shown in FIG. 3, latch 34 is biased fully counterclockwise, with trunk portion 34*c* stopped against the side of inner portion 28*b* of the handle. When the handle is moved to the right either by the circuit breaker or by manual engagement of externally extending portion 28*a*, a camming tip 28*g* formed on inner portion 28*b* engages surface 34*e* of the latch to pivot the latch clockwise until the handle reaches the position shown in FIG. 4, whereafter the latch pivots counterclockwise after camming tip 28*g* has passed a nub 34*f* on the latch. Further movement of the handle to the right is shown in FIG. 5 wherein camming tip 28*g* cams the latch clockwise by engaging surfaces 34*g* and 34*h* thereof. Thus, with the door open, it is seen that the operating handle may be moved to a "TRIPPED" or some "OFF" position, but cannot be returned to the "ON" position the latch is biased to the position shown in FIG. 4 wherein nub 34*f* acts as a stop against leftward movement of camming tip 28*g* and thus prevents movement of the handle to the "ON" position when the door is open.

When the door is closed, surface 12*a* of catch 12, FIG. 2, holds latch 34 in a clockwise pivoted position such that nub 34*f* is clear of tip 28*g* whereby the operating handle may be moved right or left.

Assume the handle is in the "ON" position, FIG. 3, and the door is attempted to be opened. The latch will start to pivot counterclockwise as arm portion 34*b* slides along surface 12*b* of the catch, FIG. 2. Arm portion 34*b* will not slide all the way to crotch 12*c* of the catch because trunk portion 34*c* will first be stopped against the side of inner portion 28*b* of the handle, as shown in FIG. 3. Flat surface 12*d* of the catch is still beneath arm portion 34*b* of the latch and thus prevents opening of the door. Even in the "TRIPPED" position, FIG. 4, flat surface 12*d* of the catch is beneath latch arm 34*b* thus prevents opening of the door. Only when the handle is manually moved fully rightward to the "OFF" position, FIG. 5, can the door be opened because camming tip 28*g* pivots the latch clockwise and thus arm portion 34*b* is moved out of the path of movement of surface 12*d*. Catch 12 moves out of the page as seen in FIGS. 3–5 when the door is opened.

It is thus seen that with the door open, the circuit breaker cannot be actuated to a circuit completing condition because of the stop provided by nub 34*f* against tip 28*g*, and that the door cannot be opened unless the operating handle is "OFF" because of the stop provided by arm 34*b* against surface 12*d*, whereby to afford the above recited interlocking functions.

It can easily be appreciated that numerous modifications of the camming and stopping surfaces of the catch, latch and handle are possible whereby to afford variations of the interlocking functions thereof. For example, it may be desirable to permit opening of the door when the handle is in the "TRIPPED" position and this may be accomplished by altering nub 28*g* and/or trunk portion 34*c*.

It may be desirable for authorized personnel, qualified repairmen, etc., to defeat the interlock in case of emergency, expediency of repair, etc. Defeater means are provided wherein the latch is rigidly mounted to pin 30, this pin having a groove 30*a* in the external end thereof, FIG. 1 and 2, wherein the pin may be turned by a screwdriver or the like to pivot the latch clockwise. Aperture 4*a* in the door is made wide enough to allow external access to pin 30 when the door is closed.

Frame 24 includes a hasp portion 24*k*, FIGS. 1 and 2, extending perpendicularly outward from the frame through the aperture in the door to be adjacent the external portion 28*a* of the operating handle. This hasp portion has an aperture 241 therein for receiving one or more locking devices, such as padlocks, etc., such that, for example, one or more repairmen can lock the handle in the "off" position while working on a load controlled by the circuit breaker and prevent operation of the handle by others who may be unaware of the danger to the one or more repairmen.

It is thus seen that operating mechanism 22 is easily usable with conventional switchgear. Furthermore, only a minimum number of parts are required and there is thus afforded inexpensive interlock protection.

The terms and expressions herein are used for purposes of description, not limitation, and there is no intention in the use of such terms and expressions of excluding any equivalents of any of the features shown, or described, or portions thereof, and it is recognized that various modifications are possible within the scope of the invention claimed.

We claim:

1. An operating mechanism for switchgear mounted in an enclosure having an openable door with an opening therein and a catch rigidly mounted thereon and immobile with respect thereto, said operating mechanism comprising:

a frame;

means mounting said frame in said enclosure;

an operating handle movably supported on said frame for movement between designated positions and extending through said opening in said door when said door is closed, said handle being operatively connected to said switchgear;

a latch movably supported on said frame for movement in a single plane and cooperable with said catch to prevent opening of said door when said handle is in a first of said designated positions, and cooperable with said handle to prevent movement of said handle to said first of said designated positions when said door is open.

2. The operating mechanism according to claim 1 wherein said latch is cooperable with said catch to permit movement of said handle between any of said designated positions when said door is closed.

3. The operating mechanism according to claim 2 wherein said latch is pivotally mounted to said frame and wherein said operating mechanism further comprises means biasing said latch in one direction of pivoting thereof.

4. The operating mechanism according to claim 3 wherein said latch is normally biased to a first angular position in the path of movement of said handle when said door is open to provide a stop against movement of said handle to said first designated position, and wherein said catch holds said latch in a second angular position against the bias of said biasing means and out of the path of movement of said handle when said door is closed to permit movement of said handle between any of said designated positions.

5. The operating mechanism according to claim 4 wherein said latch lies in the path of movement of said catch when said handle is in said first designated position to provide a stop against opening of said door, and wherein said handle holds said latch in a third angular position against the bias of said biasing means and out of the path of movement of said catch when said handle is in a second of said designated positions to permit opening of said door.

6. The operating mechanism according to claim 5 wherein said latch is in said first angular position thereof in the path of movement of said catch when said handle is in a third of said designated positions, between said first and second of said designated positions.

7. The operating mechanism according to claim 5 further comprising externally accessible defeater means for pivoting said latch out of the path of movement of said handle and said catch.

8. The operating mechanism according to claim 7 wherein said operating handle is mounted on said frame for rectilinear sliding movement.

9. The operating mechanism according to claim 5 wherein said latch has a trunk portion cooperable with said handle and an arm portion cooperable with said catch, the path of movement of said handle intersecting the pivotal arc of said trunk portion, and the path of movement of said catch intersecting the pivotal arc of said arm portion.

10. The operating mechanism according to claim 5 wherein said frame further comprises hasp means extending through said opening in said door when said door is closed, said hasp means having an aperture therein for receiving one or more locking device means for locking said handle in one of said designated positions.

11. In a switching installation having circuit breaker means mounted in an enclosure having an openable door with an opening therein, the improvement comprising:

a catch mounted on said door;

a stationary frame;

means mounting said frame within said enclosure;

an operating handle movably mounted on said frame for rectilinear sliding movement and having a portion thereof extending through said opening in said door when said door is closed, said handle being operatively connected to said circuit breaker means and movable between on and off positions corresponding to a condition of said circuit breaker means;

a latch pivotally mounted on said frame; and means biasing said latch in one direction of pivoting thereof;

said latch being biased into the path of movement of said handle to prevent movement of said handle to said on position when said door is open, said latch being engageable by said catch upon closing of said door to pivot said latch against the bias of said biasing means and out of the path of movement of said handle to permit movement of said handle to said position, said latch being biased into the path of movement of said catch to prevent opening of said door when said handle is in said on position, said latch being engageable by said handle upon movement of said handle to said off position to pivot said latch against the bias of said biasing means and out of the path of movement of said catch to permit opening of said door.

12. The invention defined in claim 11 wherein said handle is also movable to a tripped position between said on and off positions, said latch being biased into the path of movement of said catch to prevent opening of said door when said handle is in said tripped position.

13. The invention defined in claim 11 further comprising externally accessible defeater means for manually pivoting said latch against the bias of said biasing means.

14. The invention defined in claim 11 wherein said frame has a hasp portion extending through said opening in said door when said door is closed, said hasp portion being adjacent said externally extending portion of said handle to receive one or more locking devices for locking said handle in a designated position.

15. An operating mechanism for switchgear mounted in an enclosure having an openable door with an opening therein and a catch thereon, said operating mechanism comprising:

a frame;

means mounting said frame in said enclosure;

an operating handle movably supported on said frame for movement between designated positions and extending through said opening in said door when said door is closed, said handle being operatively connected to said switchgear;

a latch pivotally mounted to said frame and cooperable with said catch to prevent opening of said door when said handle is in a first of said designated positions, and cooperable with said handle to prevent movement of said handle to said first of said designated positions when said door is open, said latch being also cooperable with said catch to permit movement of said handle between any of said designated positions when said door is closed; and means biasing said latch in one direction of pivoting thereof;

said latch being normally biased to a first angular position in the path of movement of said handle when said door is open to provide a stop against movement of said handle to said first designated position;

said catch holding said latch in a second angular position against the bias of said biasing means and out of the path of movement of said handle when said door is closed to permit movement of said handle between any of said designated positions;

said latch lying in the path of movement of said catch when said handle is in said first designated position to provide a stop against opening of said door;

said handle holding said latch in a third angular position against the bias of said biasing means and out of the path of movement of said catch when said handle is in a second of said designated positions to permit opening of said door;

said latch having a trunk portion cooperable with said handle and an arm portion cooperable with said catch, the path of movement of said handle intersecting the pivotal arc of said trunk porton, and the path of movement of said catch intersecting the pivotal arc of said arm portion.

16. The operating mechanism according to claim 15 wherein said latch is generally T-shaped, the trunk of the T being said trunk portion, one of the distal ends of the crossbar of the T being said arm portion, and the other of the distal ends of the crossbar of the T being pivotally mounted to said frame.

17. The operating mechanism according to claim 16 wherein said latch is pivotally mounted to said frame by a shaft rotatably mounted to said frame, said other of the distal ends of the crossbar of the T being rigidly mounted to said shaft, said shaft being externally accessible whereby manual rotation of said shaft pivots said trunk portion of said latch out of the path of movement of said handle and pivots said arm portion of said latch out of the path of movement of said catch to defeat the interlocking functions provided thereby.

18. The operating mechanism according to claim 16 wherein said biasing means comprises a compression spring bearing between a portion of said frame and the crossbar of the T.

19. The operating mechanism according to claim 15 wherein said catch is a generally hook-shaped member having a shank portion and a crotch portion, said shank portion of said catch engaging said arm portion of said latch when said door is closed to thus hold said latch in said second angular position against the bias of said biasing means whereby said trunk portion of said latch is out of the path of movement of said handle to permit movement of said handle between any of said designated positions, said crotch portion of said catch engaging said arm portion of said latch upon opening movement of said door when said handle is in said first of said designated positions to provide a stop against opening of said door.

20. The operating mechanism according to claim 15 wherein said operating handle is mounted on said frame for rectilinear sliding movement ans has a camming portion which engages said trunk portion of said latch to pivot said latch to said third angular position against the bias of said biasing means when said handle is moved to said second of said designated positions whereby said arm portion of said latch is out of the path of movement of said catch to permit opening of said door.

21. The operating mechanism according to claim 20 wherein said trunk portion of said latch has a lateral protrusion at the distal end thereof which engages said camming portion of said handle when said latch is in said first angular position to prevent movement of said handle to said first designated position when said door is open.

22. The operating mechanism according to claim 20 wherein said frame comprises a generally planar member having an opening therein, and said operating handle comprises a generally planar portion underlying and contiguously slidable along said frame and a knob portion extending laterally through said opening in said frame and through said opening in said door when said door is closed.

23. The operating mechanism according to claim 15 wherein said latch is in said first angular position thereof when said handle is in a third of said designated positions between said first and second of said designated positions.

24. The operating mechanism according to claim 15 further comprising externally accessible defeater means for pivoting said latch out of the path of movement of said handle and said catch.

* * * * *